US007340921B2

(12) United States Patent
Cote et al.

(10) Patent No.: US 7,340,921 B2
(45) Date of Patent: Mar. 11, 2008

(54) COLD BOX AND CRYOGENIC PLANT INCLUDING A COLD BOX

(75) Inventors: Denis Cote, Sugar Land, TX (US); Jean-Pierre Gourbier, Le Plessis Trevise (FR); Richard Pawulski, Paris (FR)

(73) Assignee: L'Air Liquide - Société Anonyme à Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 323 days.

(21) Appl. No.: 10/972,828

(22) Filed: Oct. 25, 2004

(65) Prior Publication Data

US 2006/0086141 A1 Apr. 27, 2006

(51) Int. Cl.
*F25J 3/00* (2006.01)

(52) U.S. Cl. ..... 62/643; 62/907

(58) Field of Classification Search ..... 62/643, 62/907, 911

See application file for complete search history.

(56) References Cited

U.S. PATENT DOCUMENTS 3,100,385 A * 8/1963 Becker et al. ..... 62/618
3,167,417 A * 1/1965 Sellmaier ..... 62/617
4,038,060 A * 7/1977 Kamiya et al. ..... 62/617
5,412,954 A * 5/1995 Grenier ..... 62/646
6,101,840 A 8/2000 Watanabe et al.
6,128,921 A * 10/2000 Guillard et al. ..... 62/643
6,148,637 A * 11/2000 Guillard et al. ..... 62/643
6,360,545 B1 3/2002 Goldstone et al.
6,378,331 B1 4/2002 Vancauwenberghe et al.
6,910,350 B2 * 6/2005 Brigham et al. ..... 62/643
2006/0225436 A1 * 10/2006 Baudat ..... 62/50.2

OTHER PUBLICATIONS

"Tonnage Nitrogen Generation for Oil and Gas Enhanced Recovery in the North Sea", by Goldstone and Ralston, presented in the Annual Report, Session 6 of the 9th Continental Meeting of Gas Processors Association, 1992.

* cited by examiner

*Primary Examiner*—William C Doerrler
(74) *Attorney, Agent, or Firm*—Elwood L. Hayes

(57) ABSTRACT

This disclosure discusses providing safer and more accessible insulating cold boxes for cryogenic equipment. A cold box of the current invention includes a housing partially extending out of the cold box jacket wherein equipment that may need to be accessed can be located. The housing includes a breakaway barrier between the main cold box and the external housing to allow overpressures to be relieved into the cold box. Cold boxes may contain cryogenic columns, sections of cryogenic columns, distillation columns, mixing columns, storage vessels, pressure vessels, heat exchangers, and combinations thereof. The housing may contain auxiliary elements such as rotating equipment, pumps, turboexpanders, instrument devices, valves, and piping. Placing auxiliary elements in a housing outside the main cold box allows for safer access to cryogenic equipment.

5 Claims, 2 Drawing Sheets

COLD BOX AND CRYOGENIC PLANT INCLUDING A COLD BOX

BACKGROUND

The present invention relates to a cold box and a cryogenic plant including a cold box. It applies in particular to cold boxes containing cryogenic liquefiers and/or cryogenic distillation plants and especially applies to cold boxes located on ships. The cryogenic distillation plant may be an air separation unit for production of oxygen and/or nitrogen for off shore applications such as drilling platforms.

U.S. Pat. No. 6,101,840 describes a cold box having a protuberance containing part of an air separation unit. It is not possible to gain access to the contents of the protuberance without damaging the cold box.

U.S. Pat. No. 6,360,545 describes a cold box for shipboard use, wherein the cold box contains an air separation unit.

U.S. Pat. No. 6,378,331 describes a cold box for shipboard use wherein the cold box contains columns and main heat exchanger of an air separation unit. The cold box includes a double walled structure containing perlite between the walls and the elements of the air separation unit are housed within the inner wall of the structure without any perlite around them. "Tonnage Nitrogen Generation for Oil and Gas Enhanced recovery in the North Sea" by Goldstone and Ralston presented in the Annual Report, Session 6 of the 9th Continental Meeting of Gas Processors Association, 1992 describes an air separation unit for use on an oil platform.

SUMMARY

It is an objective of the invention to provide a cold box with improved safety in particular for off shore applications, such as Fischer Tropsch conversion.

It is another objective of the invention to facilitate maintenance of elements of the cold box.

According to the invention, there is provided a cold box, which will allow for improved access to facilitate maintenance of elements within a cold box comprising:

(a) a cryogenic assembly comprising the main cryogenic elements and additional auxiliary elements, wherein each main cryogenic element is selected from the group consisting of cryogenic columns, sections of such columns, storage vessels, heat exchangers and superposed combinations thereof;

(b) an outer jacket surrounding at least some of the main cryogenic elements of the cryogenic assembly, wherein the outer jacket has an outer wall and an inner wall, and (c) a base; and (d) a housing, wherein the housing contains at least one of the auxiliary elements and the auxiliary element extends at least partially outside the outer jacket, and that particular auxiliary element is connected to at least one of the main cryogenic elements within the outer jacket.

Typically, there is at least one thermal insulator filling at least part of the space between the inner and outer walls of the outer jacket. Other optional features may include one or more of the following:

the auxiliary element is selected from the group comprising pumps, turboexpanders, valves and piping;

each main cryogenic element is selected from the group consisting of distillation columns, mixing columns, storage vessels, heat exchangers and superposed combinations thereof;

there is free space between the cryogenic assembly and the inner wall of the outer jacket;

the housing is attached to the inner wall of the outer jacket;

at least one thermal insulator is perlite;

the housing is made a material chosen from the group comprising steel and aluminium;

the auxiliary element is insulated from the cryogenic assembly within the outer jacket by a barrier;

the barrier forms a weak seal, such as in the case of over pressure within the housing, the insulation barrier breaks;

the barrier is made of material chosen from the group comprising perlite, vermiculite, rock wool and metal;

the housing is situated from about 1 to from about 5 meters above the base;

the base and inner walls are impermeable to liquid leaking from the cryogenic assembly;

the housing extends within the space between the inner and outer walls of the outer jacket; and the base and inner wall of the outer jacket are impermeable to liquid.

According to additional embodiments of the invention, the cold box may be applied to cryogenic plant, an air distillation plant, or to a ship.

The main cryogenic elements are elements, which normally function at temperatures below −50° C.

The auxiliary element within the housing may also function at a temperature of below −50° C.

BRIEF DESCRIPTION OF DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

According to the invention, there is provided a cold box, which will allow for improved access to facilitate maintenance of elements within a cold box comprising:

(a) a cryogenic assembly comprising the main cryogenic elements and additional auxiliary elements, wherein each main cryogenic element is selected from the group consisting of cryogenic columns, sections of such columns, storage vessels, heat exchangers and superposed combinations thereof;

(b) an outer jacket surrounding at least some of the main cryogenic elements of the cryogenic assembly, wherein the outer jacket has an outer wall and an inner wall, and (c) a base; and (d) a housing, wherein the housing contains at least one of the auxiliary elements and the auxiliary element extends at least partially outside the outer jacket, and that particular auxiliary element is connected to at least one of the main cryogenic elements within the outer jacket.

Typically, there is at least one thermal insulator filling at least part of the space between the inner and outer walls of the outer jacket. Other optional features may include one or more of the following:

- the auxiliary element is selected from the group comprising pumps, turboexpanders, valves and piping;
- each main cryogenic element is selected from the group consisting of distillation columns, mixing columns, storage vessels, heat exchangers and superposed combinations thereof;
- there is free space between the cryogenic assembly and the inner wall of the outer jacket;
- the housing is attached to the inner wall of the outer jacket;
- at least one thermal insulator is perlite;
- the housing is made a material chosen from the group comprising steel and aluminium;
- the auxiliary element is insulated from the cryogenic assembly within the outer jacket by a barrier;
- the barrier forms a weak seal, such as in the case of over pressure within the housing, the insulation barrier breaks;
- the barrier is made of material chosen from the group comprising perlite, vermiculite, rock wool and metal;
- the housing is situated from about 1 to from about 5 meters above the base;
- the base and inner walls are impermeable to liquid leaking from the cryogenic assembly;
- the housing extends within the space between the inner and outer walls of the outer jacket; and
- the base and inner wall of the outer jacket are impermeable to liquid.

According to additional embodiments of the invention, the cold box may be applied to cryogenic plant, an air distillation plant, or to a ship.

The main cryogenic elements are elements, which normally function at temperatures below −50° C.

The auxiliary element within the housing may also function at a temperature of below −50° C.

Figure 1:
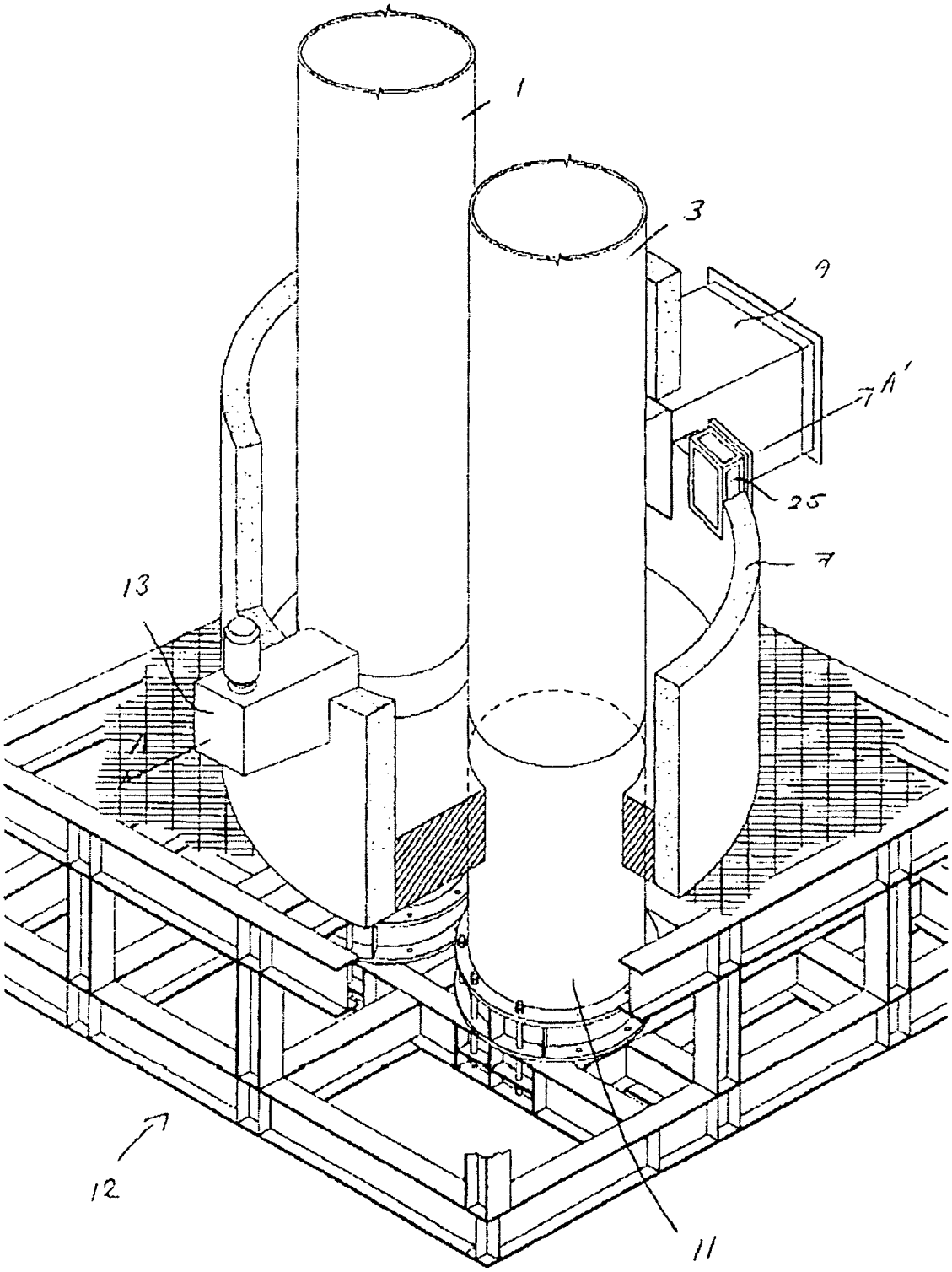
FIG. 1 is an illustration of one embodiment of the invention.

FIG. 1 illustrates a cut away view of an air distillation plant according to one embodiment of the invention. The invention and its corresponding embodiments, is described below in relation to cold boxes containing an air separation unit, but also applies to cold boxes containing additionally, or alternatively, at least one storage tank for cryogenic liquids.

The air distillation plant comprises a main cryogenic element, such as a high-pressure column 1 and a low-pressure column 3, which are thermally integrated. The two columns are placed within an outer jacket 7 having a circular cross section. The outer jacket 7, also referred to herein as the cold box, is made of resilient metal, such as stainless steel or aluminum, is placed on top of a metal framework, sometimes known as a "pancake", which is fastened to the deck 27 of a ship or floating platform.

Cooled compressed air to be sent to the high-pressure column is sent to a heat exchanger (not shown) outside the cold box via piping duct 9. The piping duct also carries conduits containing product and waste steams from the columns. One of the products is a pressurised liquid oxygen stream, which is to be vaporised in the heat exchange line. The liquid oxygen is removed from the low-pressure column, pressurised by an auxiliary element 16, such as a pump, and sent to the piping duct 9 in a conduit. The pump is located in a housing 13, which extends through an opening in the outer jacket such that the housing is directly accessible from outside the outer jacket 7. The housing 13 is made of resilient metal, such as stainless steel or aluminium. The space between the cold box and the columns is filled at least partially with particulate insulation material, such as perlite.

The cold box illustrated has a circular cross-section, but any cross-section could be used.

The low-pressure column 3 is placed on a structure 11 so as to prevent cold migration to the ship or platform deck 27, which could cause the carbon steel structure of the ship to fracture. The high-pressure column 1 is similarly insulated from the deck.

Figure 2:
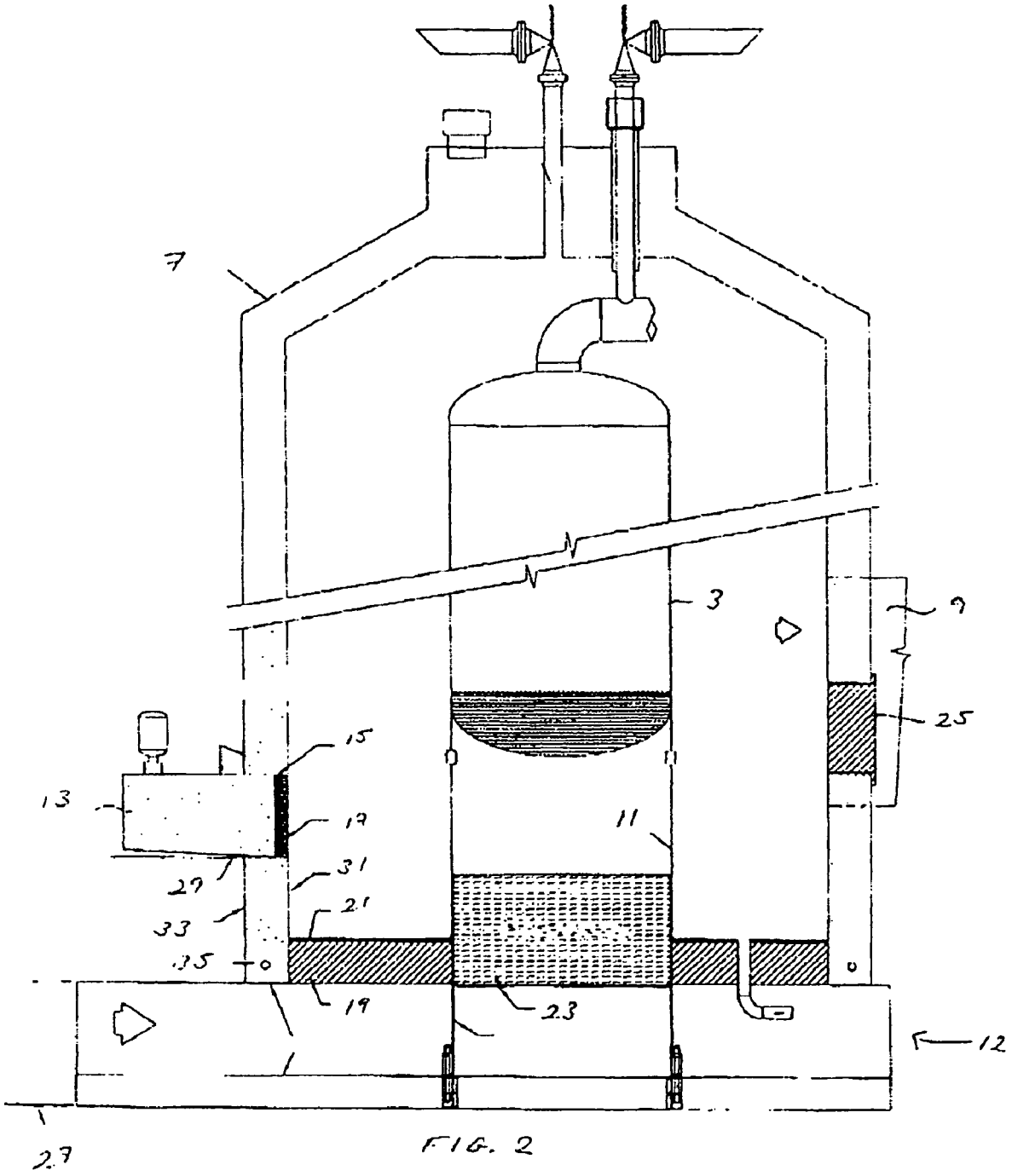
FIG. 2 is an illustration of a second embodiment.

As shown in FIG. 2, the housing 13 is sealed into an opening in the outer jacket 7, preferably welded to the inner wall 31, such that the perlite cannot escape. The housing is insulated from the interior of the cold box using a rock wool layer 15 and a non-resilient metal wall 17, such as an expanded metal layer. These layers form a weak link, which will break in the case of over-pressure allowing the liquid oxygen to flow back into the cold box 7.

The housing 13 is in the form of a cuboid that has an inner space 14 and a base wall 29 which slopes downwards towards the deck 27 of the ship, to assist the flow of any leaking liquid oxygen back into the cold box 7 after breaking through the metal wall 17. The housing may have any suitable shape.

The base 12 of the cold box is insulated using a layer of foam glass 19 covered by a sealing plate 21. The bottom of both column structures 11 is partially filled with a layer of rock wool 23.

The cold box may also be opened via an access door 25.

The housing 13 is insulated using perlite or rock wool and as well as (or instead of) a pump or pumps and their associated piping may contain at least one turboexpander and/or at least one valve and/or other piping.

The outer jacket 7 has an inner wall 31 and an outer wall 33, at least part of the space between the two being filled with perlite 35 in loose form or in the form of bricks. If the insulant is in the form of bricks, the inner wall of the jacket may be formed by the sidewalls of the bricks or may be a separate panel.

The sealing plate 21 and inner walls 31 of the outer jacket are impervious to liquid, so that if any cryogenic liquid escapes from the air separation unit will collect in the bottom of the cold box and eventually evaporates or is vaporised using a vaporiser.

A relief valve may be provided so that vapors leaking from the cryogenic unit may escape from the outer jacket.

One skilled in the art will appreciate that the air separation unit may have any number of columns. For example, it may comprise a single column, a double column, or a triple column. Additionally, a mixing column or an argon production column may be used.

The invention has been described in relation to cold boxes containing an air separation unit, but also applies to cold boxes containing additionally or alternatively, at least one storage tank for cryogenic liquids. It also applies to cold boxes containing a liquefier for producing cryogenic liquids.

Similarly, the air separation unit could be replaced by any cryogenic distillation unit, such as a unit for separating a mixture having principal components in the group comprising hydrogen, helium, methane, nitrogen, and carbon monoxide. The methods to make such a replacement are well known to those skilled in the art.

The invention also relates to cold boxes in which cryogenic liquids other than oxygen is pumped, such as nitrogen. The skill to do such an application is well known to those skilled in the art.

Preferred processes and apparatus for practicing the present invention have been described. It will be understood and readily apparent to the skilled artisan that many changes and modifications may be made to the above-described embodiments without departing from the spirit and the scope of the present invention. The foregoing is illustrative only and that other embodiments of the integrated processes and apparatus may be employed without departing from the true scope of the invention defined in the following claims.

What is claimed is:

1. A cold box apparatus comprising:

(a) a cryogenic assembly comprising:

(1) a main cryogenic element, and (2) an auxiliary element having a first part and a second part, wherein said first part is connected to said main cryogenic element, (b) an outer jacket comprising:

(1) an outer wall, (2) an inner wall, and (3) a first space between said inner wall and said outer wall, wherein said outer jacket surrounds at least some of said main cryogenic element, and wherein there is a second space between said outer jacket and said main cryogenic element, (c) a base, and (d) a housing comprising an inner space, wherein said housing extends at least partially outside said outer jacket, and wherein said second part of said auxiliary element extends at least partially into said inner space of said housing wherein said auxiliary element is insulated from said main cryogenic element by a barrier, and wherein said barrier forms a weak seal between said inner space of said housing and said second space, such that in the case of over pressure within said inner space, said barrier breaks.

2. A cold box apparatus comprising:

(a) a cryogenic assembly comprising:

(1) a main cryogenic element, and (2) an auxiliary element having a first part and a second part, wherein said first part is connected to said main cryogenic element, (b) an outer jacket comprising:

(1) an outer wall, (2) an inner wall, and (3) a first space between said inner wall and said outer wall, wherein said outer jacket surrounds at least some of said main cryogenic element, and wherein there is a second space between said outer jacket and said main cryogenic element, (c) a base, and (e) a housing comprising an inner space, wherein said housing extends at least partially outside said outer jacket, and wherein said second part of said auxiliary element extends at least partially into said inner space of said housing, wherein said housing is situated from about 1 to about 5 meters above said base.

3. A cold box apparatus comprising:

(a) a cryogenic assembly comprising:

(1) a main cryogenic element, and (2) an auxiliary element having a first part and a second part, wherein said first cart is connected to said main cryogenic element, (b) an outer jacket comprising:

(1) an outer wall, (2) an inner wall, and (3) a first space between said inner wall and said outer wall, wherein said outer jacket surrounds at least some of said main cryogenic element, and wherein there is a second space between said outer jacket and said main cryogenic element, (c) a base, and a housing comprising an inner space, wherein said housing extends at least partially outside said outer jacket, and wherein said second part of said auxiliary element extends at least partially into said inner space of said housing, wherein said housing extends within said first space.

4. A cold box apparatus, wherein said apparatus is bolted to the deck of a ship, said apparatus comprising:

(a) a cryogenic assembly comprising:

(1) a main cryogenic element, and (2) an auxiliary element having a first part and a second part, wherein said first part is connected to said main cryogenic element, (b) an outer jacket comprising:

(1) an outer wall, (2) an inner wall, and (3) a first space between said inner wall and said outer wall, wherein said outer jacket surrounds at least some of said main cryogenic element, and wherein there is a second space between said outer jacket and said main cryogenic element, (c) a base, and (d) a housing comprising an inner space, wherein said housing extends at least partially outside said outer jacket, and wherein said second part of said auxiliary element extends at least partially into said inner space of said housing.

5. An air distillation plant, wherein said air distillation plant is bolted to the deck of a ship and comprises a cold box apparatus, said apparatus comprising:

(a) a cryogenic assembly comprising:

(1) a main cryogenic element, and (2) an auxiliary element having a first part and a second part, wherein said first part is connected to said main cryogenic element, (b) an outer jacket comprising:

(1) an outer wall, (2) an inner wall, and (3) a first space between said inner wall and said outer wall, wherein said outer jacket surrounds at least some of said main cryogenic element, and wherein there is a second space between said outer jacket and said main cryogenic element, (c) a base, and (d) a housing comprising an inner space, wherein said housing extends at least partially outside said outer jacket, and wherein said second part of said auxiliary element extends at least partially into said inner space of said housing.

* * * * *

UNITED STATES PATENT AND TRADEMARK OFFICE

CERTIFICATE OF CORRECTION

PATENT NO. : 7,340,921 B2
APPLICATION NO. : 10/972828
DATED : March 11, 2008
INVENTOR(S) : Denis Cote et al.

It is certified that error appears in the above-identified patent and that said Letters Patent is hereby corrected as shown below:

In Column 5, line 64, replace the word "cart" with the word --part--.

Signed and Sealed this

Twentieth Day of April, 2010

David J. Kappos

David J. Kappos
*Director of the United States Patent and Trademark Office*